US005199901A

United States Patent [19]

Balser et al.

[11] Patent Number: 5,199,901

[45] Date of Patent: Apr. 6, 1993

[54] ELECTRICAL PLUG HOUSING WITH A KEYING DEVICE FOR AN ELECTRICAL CONTACT ELEMENT TO BE INSERTED INTO A CONTACT CHAMBER OF THE PLUG HOUSING

[75] Inventors: Michael Balser, Radevormwald-Dahlerau; Rudolf Reinertz, Wuppertal, both of Fed. Rep. of Germany

[73] Assignee: Grote & Hartmann GmbH & Co. KG, Fed. Rep. of Germany

[21] Appl. No.: 875,128

[22] Filed: Apr. 28, 1992

[30] Foreign Application Priority Data

Apr. 29, 1991 [DE] Fed. Rep. of Germany ... 9105277[U]

[51] Int. Cl.[5] ..... H01R 13/40

[52] U.S. Cl. ..... 439/587; 439/595

[58] Field of Search ..... 439/587, 595, 603, 682, 439/733, 744, 745, 746, 748

[56] References Cited

U.S. PATENT DOCUMENTS

| | | | |
|---|---|---|---|
| 3,368,185 | 2/1968 | Dell et al. | 439/748 |
| 3,697,925 | 10/1972 | Henschen | 439/603 X |
| 4,458,971 | 7/1984 | D'Urso et al. | 439/744 X |
| 4,583,805 | 4/1986 | Mantlik | 439/744 |
| 4,621,883 | 11/1986 | Noguchi . | |
| 4,902,247 | 2/1990 | Suzuki . | |

FOREIGN PATENT DOCUMENTS

| | | |
|---|---|---|
| 3703010 | 8/1988 | Fed. Rep. of Germany . |
| 3826990 | 2/1990 | Fed. Rep. of Germany . |

*Primary Examiner*—Larry I. Schwartz
*Assistant Examiner*—Khiem Nguyen
*Attorney, Agent, or Firm*—Jones & Askew

[57] ABSTRACT

An electrical plug housing with a keying device for inserting a contact element into a contact chamber of the plug housing. The contact chamber has a square cross section preceded by a sealing chamber of round cross section. An inbound contact element encounters a keying element between the sealing and contact chambers for proper alignment. The frontal edges of the keying elements are slanted to form a blunt cone-shaped funnel for aligning the contact element.

5 Claims, 2 Drawing Sheets

Figure 1:
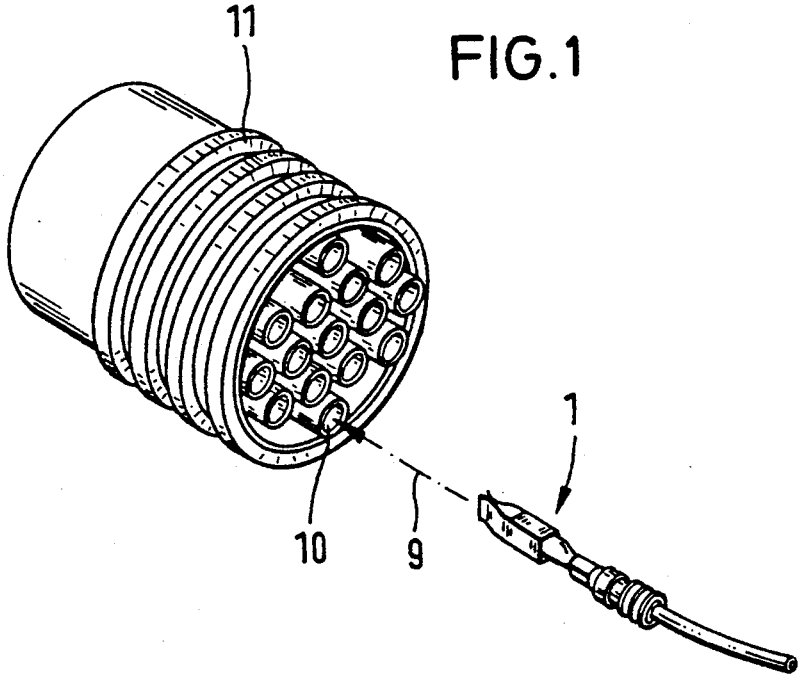

ELECTRICAL PLUG HOUSING WITH A KEYING DEVICE FOR AN ELECTRICAL CONTACT ELEMENT TO BE INSERTED INTO A CONTACT CHAMBER OF THE PLUG HOUSING

The invention pertains to an electrical plug housing with a keying device for an electrical contact element to be inserted into a contact chamber of the plug housing.

Plug housings are known that have at least one sealing chamber with cross section, placed axially in advance of a contact chamber of rectangular cross section, whereby in the transition region between the sealing chamber of greater diameter and the contact chamber of smaller diameter, a blunt conical-shaped keying funnel of round cross section is provided, whose opening into the contact chamber is square, because the keying funnel ends at the walls of the contact chamber of square cross section.

A housing chamber of this type will be occupied by a forked spring contact element shaped from a punched sheet metal part crimped to an electrical conductor wire; said forked spring contact element has a box-like spring-arm base adapted to the cross section of the contact chamber, from where forked spring arms extend forward to a contact site and at which the backward-extending crimp is located.

The forked spring arms end with a V-shaped keying funnel for a contact pin to be contacted with the forked spring contact element, whereby the contact-pin keying funnel has end edges of the same length located in parallel at a distance from each other, which are at the same time the free end edges of the fork spring arms. A contact element with a fundamental configuration of this type is widely known.

A cylindrical sealing plug made of elastic material having ribs is press-fitted onto the electrical conductor wire directly behind the crimp; the diameter of its ribs is adapted to the diameter of the sealing chamber. The sealing plug is provided to prevent the penetration of water or moisture from the side with the conductor wire to the contact site of the contact element in the contact chamber.

To occupy the chamber with a forked contact element crimped to the conductor wire, a grasper of an insertion tool grasps the conductor wire just behind the sealing plug and pushes the contact element through the sealing chamber into the contact chamber. The frontal, free end edges of the spring arms strike against the keying funnel and will be fed upon further insertion into the contact chamber. If the contact element is aligned axially to the contact chamber and is not twisted about its longitudinal axis, the keying funnel will function in the desired, known manner. But if the contact element is inserted somewhat twisted about the longitudinal axis, then the edges will push in a more or less diagonal position with regard to the contact chamber wall alignment, onto the chamber edges at the end of the funnel, with the result that the funnel can not perform its function and the insertion process is hindered. A twisting of the contact element as a rule is the consequence of a usually unavoidable twist of the flexible, thin conductor wire. Since the grasper element of the insertion device can only grasp the plugging contact element at the conductor wire due to the sealing plug, and not at the fixed, stiff crimp as for a contact element to be plugged without sealing plugs, the twist of the conductor wire is transferred to the contact element, so that inability to make electrical connection can result.

It is the task of the invention to create a contact chamber of square cross section with a plug housing having advanced sealing chambers of round cross section, with a keying device between the sealing and contact chambers, that does not prevent the insertion of contact elements having two parallel, frontal end edges and provided with sealing plug crimped to an electrical conductor wire.

BRIEF DESCRIPTIONS OF THE DRAWINGS

Figure 2:
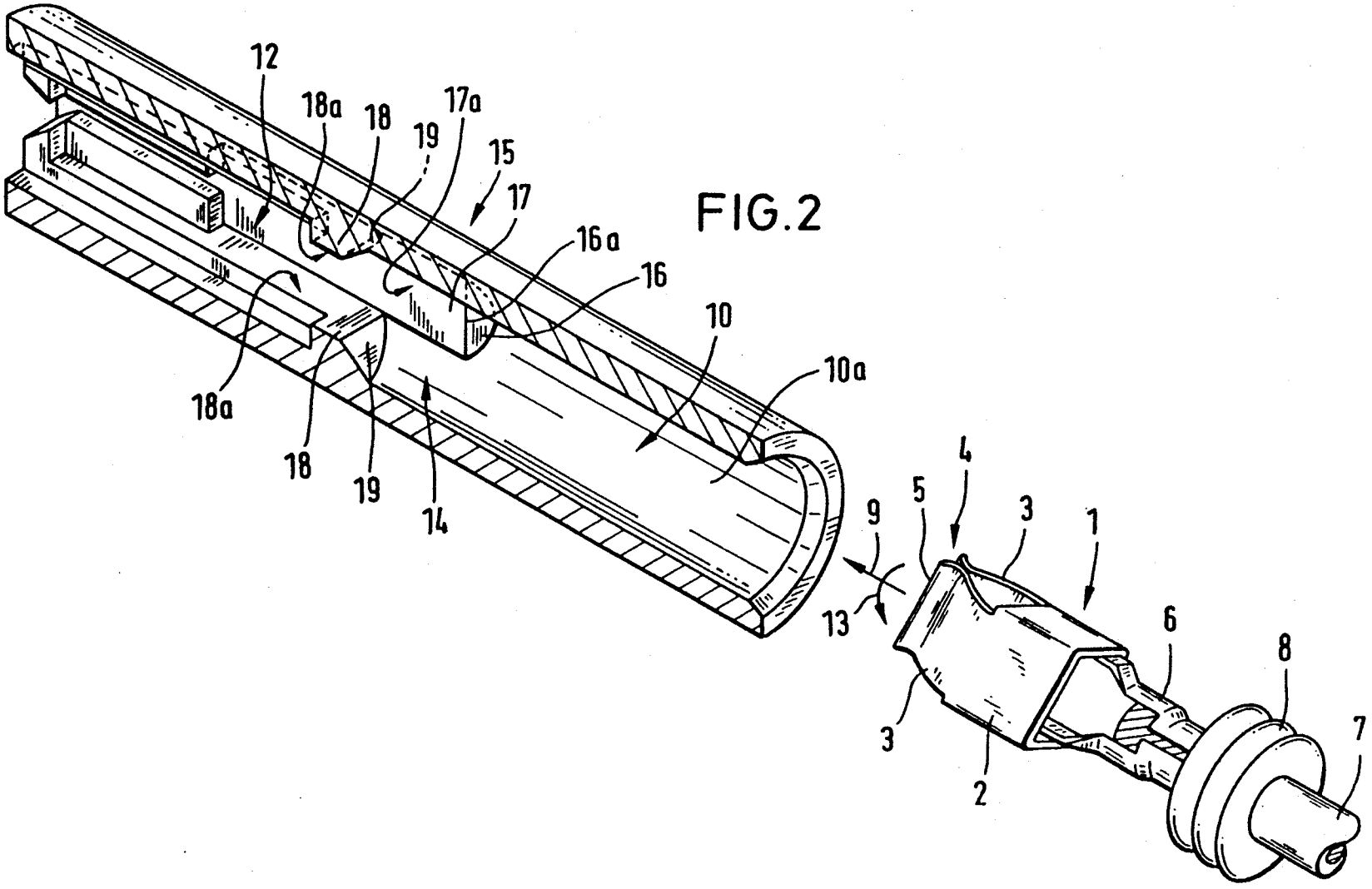

Based on the example presented in the figures, the invention will be explained in greater detail. We see:

FIG. 1: A perspective view of a plug housing and a crimped contact element;

FIG. 2: A perspective view of a longitudinal cross section through a housing chamber.

The contact element 1 to be inserted is made of a punched sheet metal part and is a forked spring contact with a box-like spring arm base 2, that has on one end, forward-extended, opposing convergent forked spring arms 3 that run out into end edges 5 of a plug pin keying funnel 4 running parallel to each other. On the other end, the crimp 6 is joined to the spring arm base 2. Behind the crimp 6 and seated on the electric conductor wire 7, is a sealing plug 8. The contact element 1 is to be inserted mechanically in the direction of arrow 9 by a grasper (not illustrated) of an insertion tool (not illustrated) through a sealing chamber 10 of round cross section, into an axially aligned contact chamber 12 of rectangular cross section of an electric plug housing 11, whereby for example, a twisting of the contact element 1 in the direction of arrow 13 with respect to the alignment of the walls of chamber 12 can be present.

The keying device 14 used per the invention to align a twisted contact element 1 is located in the transition range 15 between the sealing chamber 10 and the contact chamber 12. It consists essentially of two cross-sectional constrictions 17, 18 of circular-segmented cross section spaced in pairs in an axial direction, which arise from the inside wall of the sealing chamber 10 and run axially up to the corresponding inner wall of the contact chamber 12, whereby the surfaces **17*a*, 18*a* of the cross-sectional constrictions 17, 18 extending parallel to the longitudinal axis of the chambers 10, 12, align with the surface of the corresponding contact chamber wall. It is essential that every cross-sectional constriction 17 begins with a keying slant 16 and each cross-sectional constriction 18 begins with a keying slant 19, whereby the keying slants 16, 19** of the cooperating pairs of cross-sectional constrictions are of the same design and thus form an extensive, axially offset partial region of a blunt conical-shaped keying funnel.

Due to this invented division of the keying funnel, the prekeying slants 16 arise against which the frontal edges 5 of the contact element 1 first strike. Now if the frontal edges 5 do not run parallel to the free slanting end edges **16*a* of the slant 16, that is, if the contact element 1 is twisted, then the edges 5 and thus the contact element 1 will be aligned by the slants 16 in such a manner that the edges 5 run parallel to the edges 16*a*. The contact element 1 can then strike aligned to the slants 19 and can readily slide into the contact chamber 12. Accordingly, it may be useful to place the slants 16 bearing the edges 5 in advance of the slants 19** in the direction of the plug axis.

We claim:

1. An electrical plug housing with a keying device for a crimped, electrical contact element with a sealing plug and operative for insertion into a contact chamber with an advanced sealing chamber in the plug housing, whereby the sealing chamber has a round cross section and the contact chamber has a rectangular cross section, and the front end of the contact element has two edges aligned parallel to each other, characterized in that the keying device (14) comprises:

(a) a prekeying device operative for engagement by the contact element, the prekeying device located in advance in the axial direction of the plug and in the form of two paired cross-sectional constrictions (17) located radially opposite each other in the sealing chamber (10) and of circular segmented cross section, that are each provided with an inlet slant (16); and (b) two paired, opposing cross-sectional constrictions (18) in the sealing chamber (10) likewise of circular, segmented cross section, and featuring two insertion slants (19) behind and in the sealing chamber (10) in the axial direction of the prekeying device, which are positioned around the perimeter of the wall of the sealing chamber (10) offset 90° to the cross-sectional constrictions (17), whereby the contact element first contacts the prekeying device for predetermined axial alignment and then passes between the constrictions to enter the contact chamber.

2. A plug housing according to claim 1, characterized in that the cross-sectional constrictions (17, 18) have surfaces (17*a*, 18*a*) extending and aligned to the corresponding walls of the contact chamber (12).

3. A plug housing according to claim 1, characterized in that the cross-sectional constrictions (17, 18) are of the same design.

4. A plug housing according to claim 1, characterized in that the slants (19) end at a mouth of the contact chamber (12) and with walls (17*a*) form the mouth of the contact chamber (12).

5. A plug housing according to claim 1, characterized in that the axial spacing between the slants (16 and 19) roughly corresponds to the spacing of edges (5) from a spring arm base (2) of one contact element (1).

* * * * *